US006494249B1

(12) United States Patent
Kollberg et al.

(10) Patent No.: US 6,494,249 B1
(45) Date of Patent: Dec. 17, 2002

(54) METHOD AND DEVICE FOR CONTROL OF METAL FLOW DURING CONTINUOUS CASTING USING ELECTROMAGNETIC FIELDS

(75) Inventors: Sten Kollberg, Västerås (SE); Carl Petersohn, Stockholm (SE); Göte Tallbäck, Västerås (SE); Jan-Erik Eriksson, Västerås (SE); Magnus Hällefält, Kvicksund (SE)

(73) Assignee: ABB AB, Vasterås (SE)

( * ) Notice: Subject to any disclaimer, the term of this patent is extended or adjusted under 35 U.S.C. 154(b) by 0 days.

(21) Appl. No.: 09/486,764

(22) PCT Filed: Aug. 31, 1998

(86) PCT No.: PCT/SE98/01547

§ 371 (c)(1),
(2), (4) Date: May 4, 2000

(87) PCT Pub. No.: WO99/11403

PCT Pub. Date: Mar. 11, 1999

(30) Foreign Application Priority Data

Sep. 3, 1997 (SE) ..... 9703169

(51) Int. Cl.[7] ..... B22D 11/00; B22D 27/02

(52) U.S. Cl. ..... 164/452; 164/466; 164/502; 164/154.1

(58) Field of Search ..... 164/466, 502, 164/452, 154.1

(56) References Cited

FOREIGN PATENT DOCUMENTS

JP 9-277006 * 10/1997

* cited by examiner

*Primary Examiner*—Kuang Y. Lin
(74) *Attorney, Agent, or Firm*—Dykema Gossett PLLC

(57) ABSTRACT

A method and a device for continuous or semi-continuous casting of metal. A primary flow (P) of hot metallic melt supplied into a mold is acted upon by at least one static or periodically low-frequency magnetic field to brake and split the primary flow and form a controlled secondary flow pattern in the non-solidified parts of the cast strand. The magnetic flux density of the magnetic field is controlled based on casting conditions. The secondary flow (M, U, C1, C2, c3, c4, G1, G2, g3, g4, O1, O2, o3, o4) in the mold is monitored throughout the casting and upon detection of a change in the flow, information on the detected change monitored flow is fed into a control unit (44) where the change is evaluated and the magnetic flux density is regulated based on this evaluation to maintain or adjust the controlled secondary flow.

33 Claims, 4 Drawing Sheets

METHOD AND DEVICE FOR CONTROL OF METAL FLOW DURING CONTINUOUS CASTING USING ELECTROMAGNETIC FIELDS

TECHNICAL FIELD

The present invention relates to a method for casting of metals, and in particular to a method for continuous or semi-continuous casting of a strand in a mold, wherein the flow of metal in non-solidified parts of the cast strand is acted on and controlled by at least one static or periodically low-frequency magnetic field applied to act upon the molten metal in the mold during casting. The present invention also relates to a device for carrying out the invented method.

BACKGROUND ART

In a process for continuous or semi-continuous casting, a metallic melt is chilled and formed into an elongated strand. Depending on its cross-section dimensions, the strand is called a billet, a bloom or a slab. During casting a primary flow of hot metal is supplied to a chilled mold wherein the metal is cooled and at least partly solidified into an elongated strand. The cooled and partly solidified strand leaves the mold continuously. At the point where the strand leaves the mold, it includes at least a mechanically self-supporting skin surrounding a non-solidified center. The chilled mold is open at both of its ends in the casting direction and is preferably associated with means for supporting the mold and means for supplying coolant to the mold and the support. The chilled mold preferably includes four mold plates, preferably made of copper or other material with a suitable heat conductivity. The support means are preferably beams with internal channels for supply of coolant, normally water, thus such support beams are often called water beams. The water beams are arranged around and in good thermal contact with the chilled mold to fulfill its double function of supporting and cooling the mold.

The hot primary metal flow is supplied either through a nozzle submerged in the melt (closed casting), or through a free tapping jet (open casting). These two alternative methods create separate flow situations and effects how and where the magnetic field(s) is/are applied. If the hot primary metal flow is allowed to enter the mold in an uncontrolled manner, it will penetrate deep in the cast strand, which is likely to negatively effect its quality and productivity. Non-metallic particles and/or gas might be drawn in and entrapped in the solidified strand. An uncontrolled hot metal flow in the strand might also cause flaws in the internal structure of the cast strand. Also a deep penetration of the hot primary flow might cause a partial remelt of the solidified skin, such that melt penetrates the skin beneath the mold, causing severe disturbance and long down-time for repair. To avoid or minimize these problems and improve the production conditions, according to the disclosure in European Patent Document EP-A1-0 040 383, one or more static magnetic fields can be applied to act on the incoming primary flow of hot melt in the mold to brake the incoming flow and split it up to create a controlled secondary flow in the molten parts of the strand. The magnetic field is applied by a magnetic brake which includes one or more magnets. Favorably, an electromagnetic device, i.e., a device comprising one or more windings such as a multi-turn coil wound around a magnetic core, are used. Such an electromagnetic brake device is called an EMBR.

According to the disclosure in European Patent document EP-B1-0 401 504, magnetic fields are applied in two levels, arranged one after the other in the casting direction, during casting with a submerged entry nozzle (closed casting). The magnets include poles having a magnetic band area covering essentially the whole width of the cast strand and one first level is arranged above and one second level below the outlet ports of the submerged nozzle. Further, EP-B1-0 401 504 teaches that the magnetic flux should be adopted to the casting conditions, i.e., the strand or mold dimensions and casting speed. The magnetic flux and the magnetic flux distribution are adopted to ensure a sufficient heat transport to the meniscus to avoid freezing while at the same time the flow velocity at the meniscus is limited and controlled so that the removal of gas or inclusions from the melt is not put at risk. A high uncontrolled flow velocity at the meniscus might also cause mold powder to be drawn down into the melt. It is also suggested in this document that an optimum range exists for the flow velocity at the meniscus, see FIG. 9. It is suggested that the magnetic flux density over the mold is adopted before a casting operation based on the specific conditions assumed to prevail during the coming cast operation. To accomplish this EP-B1-0 401 504 suggests a mechanical magnetic flux-controlling device which is arranged to move the magnetic poles in essentially their axial direction to change the distance between the poles comprised in one cooperation pair and arranged facing each other on opposite sides of the mold, see FIG. 15 and column 8, lines 34 to 50. Such a mechanical magnetic flux-controlling device must however be extremely rigid to accomplish a stable magnetic flux density, especially when subject to the large magnetic forces prevailing under operation of the brake while at the same time being capable of small movements to accomplish the adjusting changes in flux density required as the flux density has a high sensitivity to changes in the distance between the poles. Such a mechanical magnetic flux density-controlling device requires a combination of heavy gauge material, rigid construction and small movements in the direction of the magnetically field, which will be hard and costly to accomplish. According to one alternative embodiment the mechanical flux density device is formed by partial substitution of the poles by non-magnetic material such as stainless steel, i.e., by a change in the configuration of the poles and thereby an alteration of the pattern of the magnetic flux in the mold before each cast. Similar ideas as to the configuration of the poles, are discussed in other documents such as EP-Al-577 831 and WO 92/12814. The patent document WO 96/26029 teaches the application of magnetic fields in further levels including one or more levels at or just downstream of the exit end of the mold to further improve the control of the secondary flow in the mold. Flux density-controlling devices of these types based on reconfiguration and/or movements of the poles by mechanical means must be complemented with means for securing the magnet core or partial cores to withstand the magnetic forces and is thus intended for presenting the magnetic flux density and adopted to casting conditions predicted to prevail during a forthcoming casting, and it will include costly and elaborative development work to use such devices for on-line regulation of the magnetic flux density.

According to European Patent Document EP-A1-0 707 909, the flow velocity at the meniscus shall be set within a range of 0.20–0.40 m/sec for a continuous casting method wherein a primary flow is supplied to mold through a nozzle capable of controlling the incoming flow and wherein a static magnetic field having a substantially uniform magnetic flux density distribution over the whole width of the mold is applied to act on the metal in the mold. It further teaches that the flow at the meniscus can be held within this range by setting several parameters such as;

the angle of the port(s) in the submerged nozzle;

the position of the nozzle ports) within the mold;

the position of the magnetic field; and the magnetic flux density.

The angle and position of the nozzle port(s) as well as the position of the magnetic field(s) are determined and preset before the start of casting and the magnetic flux is controlled according to one out of two different algorithms. The choice of algorithm to be used is dependent on the position of the magnetic field relative the primary flow, i.e., if the primary flow out of the nozzle port(s) traverses a magnetic brake field or not before hitting the side-wall. The algorithms) are based on one measured value only, the flow velocity at the meniscus when no magnetic field is applied, i.e., a historical value measured at an earlier casting or possible at the start of the casting if the casting are started with the brake off. The other values of the algorithms are all preset. The values included are the mold width and thickness which truly is constant and the average flow velocity of molten steel through the nozzle port(s), i.e., the primary flow, which is treated as a constant value or possibly as a predetermined function of time. Thus will in fact the magnetic flux density also according to this method be preset as it will be based on predetermined and preset parameters only and the control will not account for any change in the actual casting conditions or a dynamically progressing process and will consequently not be capable of adjusting the flux density on-line based on a change in the actual flow. Examples of parameters or conditions which effect the secondary flow and are likely to change during casting are the ferrostatic pressure at the nozzle port(s), nozzle angle(s) or nozzle dimensions due to erosion or clogging, the superheat in the primary flow, i.e., its temperature relative the melting point, chill at meniscus, and level of meniscus in mold. The primary flow might also have to be adopted due to a change in casting speed or other separately controlled production parameter.

OBJECTS OF THE INVENTION

It is a primary object of the present invention to provide a method for continuous casting of metal wherein the flow in the mold is controlled during casting by an on-line regulation of the magnetic flux density of a magnetic field applied to act on the metal to brake and split the incoming primary flow of hot metal and form a controlled secondary flow pattern in the mold. The on-line regulation shall be provided throughout essentially the whole casting and be based on the actual casting conditions or operating parameters prevailing in the mold or effecting the conditions in the mold at that moment to provide a cast product with a minimum of defects produced at the same or improved productivity.

As the flow at the meniscus has been shown critical for both removal of impurities, trapping of mold powder and gas and indicative of the flow situation prevailing in the mold, it is also an object of the present invention to monitor the flow at the meniscus throughout the casting by direct or indirect methods and include any change detected in this flow in the online regulating of the magnetic flux density to ensure a minimum of trapping or accumulation of non-metallic inclusions, mold powder or gas in the cast products. It is further an object of the present invention to provide a device for carrying out the invented method.

Other advantages of the present invention will became apparent from the description of the invention and the preferred embodiments of the invention, including its capabilities to provide an improved and controlled flow pattern throughout the casting also when one or more parameters change and the thereby increased capability to, over a wide range of operating parameters, mold dimensions, metal compositions, etc., control the solidification conditions in the cast product, conditions for removal of non-metallic impurities from the cast product and the entrapment of mold powder or gas in the cast products, so that even when one or more of these parameters changes for whatever reason during casting, the casting conditions can remain essentially stable or be adjusted to be within preferred limits.

SUMMARY OF THE INVENTION

To achieve this in the inventive casting method (continuous or semi-continuous), a primary flow of hot metallic melt is supplied into a mold and at least one static or periodically low-frequency magnetic field is applied to act on the melt in the mold. One or more magnetic fields are arranged to brake and split the primary flow and form a controlled secondary flow pattern in the non-solidified parts of the cast strand. To achieve the desired secondary flow the magnetic flux density of the magnetic field is regulated based on casting conditions. To accomplish the primary object of the invention, the secondary flow in the mold is monitored throughout the casting and any detected change in the monitored flow is fed into a control unit where the change is evaluated. The magnetic flux density is thereafter regulated based on this evaluation to maintain or adjust the controlled secondary flow. Preferably the flow velocity of the secondary flow in at least one specific point in the mold is measured continuously throughout essentially the whole casting. As an alternative to the continuous measurement of the flow velocity, the flow velocity can also be discontinuously (intermittently) measured or sampled throughout essentially the whole casting operation. Upon detection of any change in the flow, information on this change will, whether detected by continuously measurement or sampling, be fed into the control unit where it is evaluated. The magnetic flux density is thereafter regulated based on this evaluation.

A device for carrying out the invented method for continuous or semicontinuous casting of metals comprises a mold for forming a cast strand, means for supply of a primary flow of a hot metallic melt to the mold, and magnetic means arranged to apply at least one magnetic field to act upon the metal in the mold and is according to the present invention arranged with the magnetic means associated with a control unit. The control unit is associated with detection means which are arranged to monitor metal flow in the mold and detect any changes in the flow. Upon detection of a change in the casting conditions or in the flow information, the change is fed into the control unit which comprises evaluation means to evaluate the detected change and control means to regulate the magnetic flux density of the magnetic field based on the evaluation of the detected change in the flow.

The detection means can be any known sensor or device for direct or indirect determination of the flow velocity in a hot metallic melt, such as flow sensors based on eddy current technology or comprising a permanent magnet, temperature sensors by which a temperature profile of, e.g., one of the narrow sides or the meniscus can be monitored, a level sensing device for determination and supervision of level height and profile of a melt surface in a mold, the meniscus. Suitable detection means will be exemplified and described in more detail in the following.

The control unit comprises means, preferably in the form of an electronic device with software in the form of a algorithm, statistical model or multivariate data-analysis for processing of casting parameters and information from the detection means on flow, and means for regulating the magnetic flux density based on the result of the processing. According to one embodiment of the invention, the control unit is arranged within a neural network comprising electronic means for supervision and control of further steps and devices associated with the casting operation. The control unit also includes means for the regulation of the magnetic flux density of the magnetic brake. For an electromagnetic brake this is best accomplished by control of the amperage fed to the windings in the electromagnets of the electromagnetic brake. This is accomplished by any current limiting device controlled by an out-signal from the control unit. Alternatively, for an electromagnet which is connected to a voltage source, the voltage can be controlled by the out-signal from the control unit, thus indirectly controlling the amperage of the current in the magnet windings. The control unit will be further exemplified in the following.

As the flow conditions can vary within the mold, has it in some cases been shown desirable to monitor the flow at two or more locations within the mold and also to apply the magnetic fields in such a way that the magnetic flux density of one magnetic field can be regulated separately and independently of any other magnetic fields based on the flow prevailing in the part of the mold on which the magnetic field is applied to act. The typical situation is that for a slab mold wide two wide sides and a tapping point in the center of the mold, at least one magnetic circuit is arranged to apply at least one magnetic to act on the melt in each half of the mold, i.e., the mold is, in the casting direction, split into two control zones, each control zone comprising a half of the mold and is disposed on each side of a plane comprising the center line of the wide sides. The flow at the meniscus is measured directly or indirectly for both control zones, i.e., mold halves, and the left control zone sensor is associated with means for regulating the magnetic flux density of a magnetic field acting on the melt in the left half of the mold and a right control sensor is associated with means for regulating the magnetic flux density of a magnetic field acting on the melt in the right half of the mold. The mold can, naturally, be divided into zones of any number and shapes where at least one sensor and at least one magnetic flux density-regulating means is associated with each zone. Using two control zones ensures that an essentially symmetrical two-loop flow is developed in the upper part of the mold and that the risks of the two-loop flow developing to an unsymmetrical or unbalanced flow showing, e.g., marked differences in the flow velocities at the meniscus for the two mold halves, a so called biased flow, or even in the extreme case transforming into an undesired one-loop flow, where the melt flows up along one molds side, across the meniscus to the other side, down and further back across the mold at level with or just downstream the nozzle ports, is essentially eliminated.

According to one embodiment, the flow velocity at the meniscus ($v_m$) is monitored or sampled. Upon detection of a change in flow velocity at the meniscus ($v_m$), information on this change is fed into the control unit, where it is evaluated. Based on this evaluation, the magnetic flux density is regulated in a suitable way to either maintain the secondary flow pattern or, should it be deemed suitable, change the flow. According to one preferred embodiment, the magnetic flux density is then controlled to maintain or adjust the flow velocity at the meniscus ($v_m$) to be within a predetermined flow velocity range.

According to one alternative embodiment, the upwardly-directed secondary flow ($v_u$) at one of the molds narrow sides is monitored or sampled. Upon detection of a change in this upwardly-directed flow velocity ($v_u$), information on this is fed into the control unit. Based on this evaluation the magnetic flux density is regulated to maintain or adjust the flow velocity of this upwardly-directed flow ($v_u$) or, as the flow at the meniscus ($v_m$) is a function of this upwardly-directed flow, to maintain or adjust the flow at the meniscus ($v_m$) to be within a predetermined flow velocity range. This flow velocity range will vary with casting speed, nozzle geometry, nozzle immersion depth, and when gas is purged, the gas flow, superheat and mold dimensions, but shall for the casting slab using a submerged entry nozzle with side ports and a moderate casting speed normally be held within the range mentioned in the foregoing.

According to one further alternative embodiment, the profile of the meniscus, part of this profile or a parameter characterizing it such as the height ($h_w$), location and/or shape of a standing wave, which is generated in the meniscus by the upwardly-directed secondary flow at one of the molds narrow sides, is supervised or sampled throughout essentially the whole casting. The profile of the meniscus and especially the standing wave is closely dependent on the upwardly-directed flow ($v_u$), as is also, as referred to in the foregoing paragraph, the flow velocity at the meniscus. Therefore can any detected change in the profile such as the height, location or shape of this standing wave be correlated to a flow velocity. Based on such correlation or evaluation the magnetic density is regulated to maintain the standing wave, the flow velocity of the upwardly-directed flow and/or the flow velocity at the meniscus within predetermined limits.

According to one preferred embodiment of the present invention the algorithm, statistical model or data-analysis method used for processing the detected changes also includes parameter values for one or more predetermined parameters out of the following group of parameters;

- mold dimensions,
- nozzle dimensions and nozzle configuration including the angle of the ports,
- dimensions, configuration and position of magnetic poles;
- composition of metal cast;
- composition of mold powder used.

Such a parameter value is included in the algorithm, statistical model or method for data analysis used to evaluate the determined change to the flow and regulate the magnetic flux density of the magnetic field on-line. The parameter is included as a constant value or if relevant as a time-dependent function, which is assumed to vary in a known way over the casting sequence or as a function of any other casting parameter or flow. Examples of dependent parameters which value can be included in the algorithm, statistical model or method for data-analysis as a function of time or other parameter are;

- changes in primary flow due clogging and/or wear of nozzle;
- superheat of primary flow, i.e. metal upon entry in the mold;
- ferrostatic pressure at nozzle exit.

According to one preferred embodiment of the present invention, one or more out of the following group of parameters is monitored or sampled together with the secondary flow during casting;

- superheat of the metal upon entry in mold;
- ferrostatic pressure at nozzle exit;
- flow velocity of primary flow upon exit from nozzle;
- any gas bubbling in mold;

casting speed;

mold powder addition rate;

position of meniscus in mold and relative nozzle port;

position of nozzle port relative mold;

position of magnetic field(s) relative meniscus and nozzle ports;

direction of magnetic field; and any other casting parameter deemed critical for the secondary flow and which is likely to change during casting.

Preferably one or more these parameters is supervised or sampled throughout essentially the whole casting process and included on-line in the algorithm, statistical model or method for data analysis used to evaluate the determined change to the flow and regulate the magnetic flux density of the magnetic field on-line. The changes can be due to a time-dependent process or be due to an induced change of the casting conditions. These parameters which are accommodated for in the algorithm, statistical model or method for multivariate data-analysis will thereby effect the on-line regulation of the magnetic flux so that the magnetic flux density can be adopted to these changes and a better control of the secondary flow is accomplished.

Preferably the algorithm, numerical model or method for multivariate data analysis used in addition to the monitored or sampled flow parameters also include further casting parameters in the form of preset or predetermined constants, predetermined functions as well as monitored or sampled parameter values. Thus will the controlled secondary flow be more stable and well adopted to give the preferred flow pattern for the conditions actual prevailing in the mold.

According to a further embodiment, the control unit is also associated to one or more further electromagnetic devices, which are arranged to apply one or more alternating magnetic fields to act upon the melt in the mold or in the strand. Such electromagnetic device are stirrers which can be arranged to act on the melt in the mold or on the melt down-streams of the mold, e.g., on the last remaining melt in the so called sump but also high-frequency heaters are used preferably applied to act on the melt adjacent to the meniscus to avoid freezing, melt mold powder and provide good thermal conditions, e.g., when casting with low superheat.

The present invention according provides means to adopt the flow and thereby also thermal conditions to achieve the desired cast structure while ensuring the cleanliness of the cast product and same or improved productivity. The embodiments which include monitoring or sampling of further parameters and/or information on induced changes in production parameters are especially favorably as they provide the possibility to, upon the detection of a change in a casting parameter, adopt the magnetic flux density to counteract any disturbance like to come as a result of this change or take measures to minimize such a disturbance known to be the result of such change.

BRIEF DESCRIPTION OF THE DRAWINGS

Some embodiments of the invention shall in the following be described in more detail while referring to the drawings where;

FIGS. 5, 6, 7 and 8 exemplify flow patterns obtained with further embodiments of the present invention, wherein FIGS. 5 and 6 illustrate embodiments where magnetic fields are applied at one level only; FIG. 7 illustrates an embodiment where the present invention is used to stabilize a reversed flow; and FIG. 8 illustrates an embodiment where the flow is monitored separately in each mold half and where the magnetic field acting in one half of the mold is regulated independently of the magnetic field acting in the other half.

DESCRIPTION OF PREFERRED EMBODIMENTS, EXAMPLES.

Figure 1:
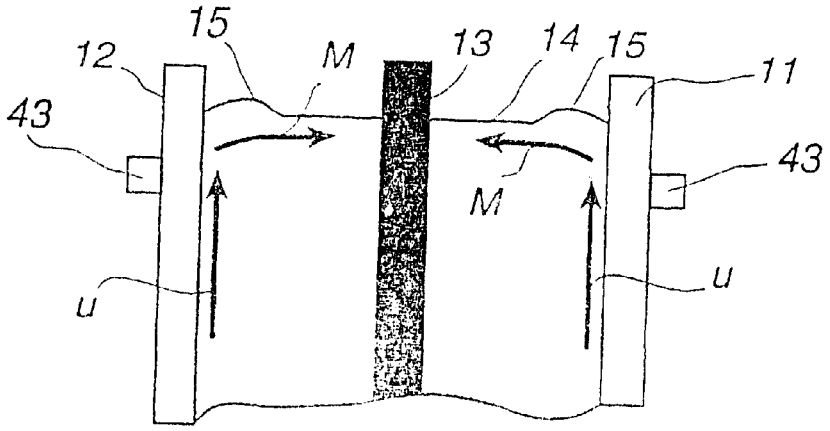
FIG. 1 is a schematic illustration of the top end of one embodiment of a mold for carrying out the invented method, showing the meniscus and a typical secondary flow.

In FIG. 1 the top end section of a mold, typical for continuous casting of large slabs, is shown. The mold includes four chilled mold plates 11, 12, of which only the narrow side plates are shown. The plates are preferably supported by so called water beams, not shown. These water beams also preferably define internal cavities or channels for coolants, preferably water. During casting, according to the embodiment of the present invention shown in FIG. 1, the primary flow of hot metal is supplied through a nozzle 13 submerged in the melt. Alternatively, the hot metal can be supplied through a free tapping jet, open casting. The melt is cooled and a partly solidified strand is formed. The strand is continuously extracted from the mold. If the hot primary metal flow is allowed to enter the mold in an uncontrolled manner, it will penetrate deep into the cast-strand. Such a deep intrusion in the stand is likely to effect the quality and productivity negatively. An uncontrolled hot metal flow in the cast strand might result in entrapment of non-metallic particles and/or gas in the solidified strand. or cause flaws in the internal structure of the cast strand due to disturbance of the thermal and mass transport conditions during solidification. A deep penetration of a hot flow might also cause a partial remelt of the solidified skin, such that melt penetrates the skin beneath the mold, causing severe disturbance and long down-time for repair.

According to the method illustrated in FIG. 1, one or more static magnetic fields are applied to act on the incoming primary flow of hot melt in the mold to brake and split up the incoming flow. Thereby a controlled flow pattern is created in the molten parts of the strand. According to the method for continuous casting of metal shown, the primary flow of metal enters the mold through side ports in a submerged entry nozzle and a secondary flow develops as this flow is split and hits the narrow side of the mold. The flow in the upper part of the mold is controlled by the magnetic field applied and exhibits a typically upwardly-directed flow U along the narrow side walls, a flow M along and adjacent to the meniscus 14, and a standing wave 15 which is formed in the meniscus adjacent to the narrow side wall.

Figure 7:
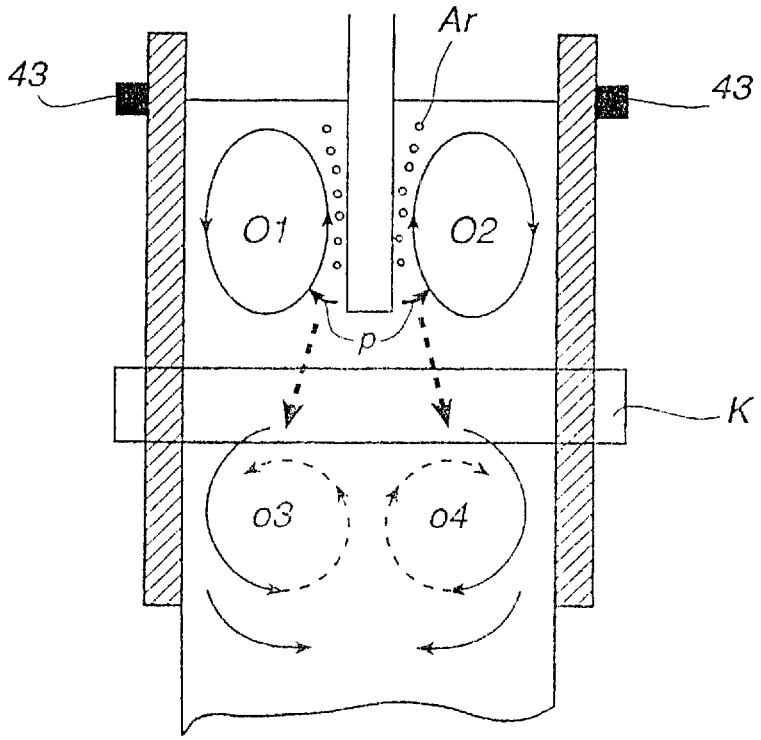

A reversed secondary flow, see 01 and 02 in FIG. 7, upwardly directed in the center of the mold and outwards towards the narrow sides at the meniscus, might also develop during special conditions, e.g., when gas is purged through the nozzle to avoid deposition and clogging in the nozzle. The flow M at the meniscus, and especially the velocity of the flow $v_m$, has been shown critical for both removal of impurities, trapping of mold powder and gas and is indicative of the flow situation prevailing in the mold. It has therefore proven favorable to, according to one embodiment of the present invention, monitor the flow at the meniscus throughout the casting by direct or indirect methods and include any change detected in this flow M in the on-line regulating of the magnetic flux density to ensure a minimum of trapping or accumulation of non-metallic inclusions, mold powder or gas in the cast products. As both the meniscus flow M and the height, position and shape of the standing wave 15 in most situations are dependent on the upwardly directed flow U, it has been shown possible to base the on-line regulation according to the present invention also on direct or indirect measurements of the flow U, or the nature, or location of the standing wave. All these parameters can be monitored continuously or sampled throughout a casting using, e.g., devices 43 based on eddy-current technology or comprising a permanent magnet or other devices adopted for determination of flow velocity or levels of a liquid or melt contained within a vessel, such as a mold or a ladle. Thus, the on-line regulation according to the present invention favorably comprises the continuous measurement or sampling of any of these parameters. Hereby it has been proven that the method according to the present invention improves the capabilities to provide a controlled and stable flow pattern throughout the casting and also to provide capabilities to adjust the flow if so desired. The method also exhibits an increased capability to control, stabilize and adjust the in-mold flow during continuous casting based on continuous monitoring or sampling of a plurality of operating parameters and thereby provide improved solidification conditions in the cast product, improved conditions for removal of no-metallic impurities from the cast product and improved conditions for minimizing entrapment of mold powder or gas in the cast products, so that even when one or more of the operating parameters changes for whatever reason during casting, the casting conditions can remain essentially stable or be adjusted to be within preferred limits.

Figure 2:
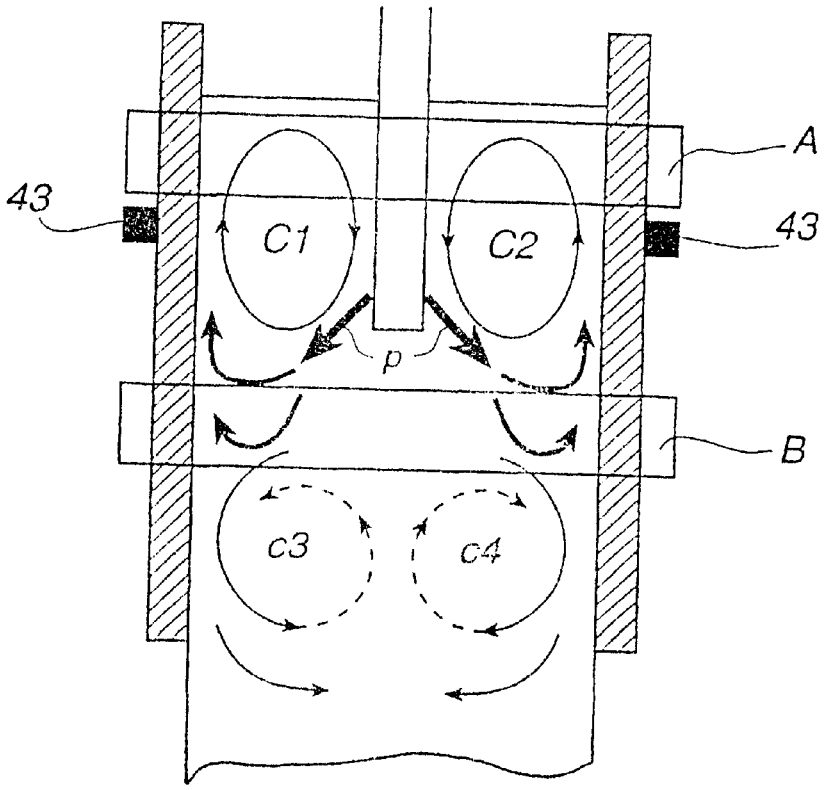
FIGS. 2 and 3 exemplify flow patterns obtained with embodiments of the present invention, where an electromagnetic brake is applying magnetic brake fields to act in two magnetic band areas at two separate levels within a mold and where the primary flow of hot metal enters the mold through side ports of a submerged entry nozzle and at least one magnetic band area is arranged at level or downstream the side-ports.

The flow pattern illustrated in FIG. 2 is typically developed for a method where a primary flow p of the hot melt enters the mold through side ports of a submerged entry nozzle and a brake is adapted to apply magnetic fields to act on the metal in the mold in;

- a first magnetic band area A at a level with the meniscus or at a level between the meniscus and the side ports; and
- a second magnetic band area B at a level downstream the side ports.

The width of the magnetic band areas covers preferably as shown in FIG. 2 essentially the whole width of the cast product. This configuration of the magnetic band areas A,B, provides a significant circulating secondary flow C1 and C2 in the top end of the mold, between the two levels of the magnetic band areas A, B, which is monitored by flow sensors 43. Downstream of the second magnetic band area B might also a less stable circulating flow c3 and c4 develop, but the secondary flow is, when casting according to the embodiment illustrated in FIG. 2, characterized by the braking and split of the primary flow caused by magnetic band area B resulting in a stable secondary flow C1 and C2 created by the cooperation of magnetic forces, induced currents and the momentum of the primary flow in the region between the two band areas. In the situation shown in FIG. 2 the secondary flow C1 and C2 are preferably supervised by monitoring them, using suitable sensors 43 located either at the meniscus, at the narrow side or by monitoring the standing wave. The magnetic flux density is preferably regulated to maintain the flow C1 and C2 within preset limits, but at times it might prove favorable to regulate the magnetic flux density such that the polarity of one or both magnetic band areas is reversed. By arranging sensors 43 for monitoring the flows C1 and C2 separately, the flows C1 and C2 can also be controlled independently provided that the magnetic field forces acting on the melt can be controlled for each half of the mold.

According to an alternative embodiment used in a similar mold and also for closed casting (FIG. 3), the magnetic fields are applied to act in;

- a first magnetic band area D at a level with the side ports openings of the submerged entry nozzle; and
- a second magnetic band area E at a level downstream the side ports.

Figure 3:
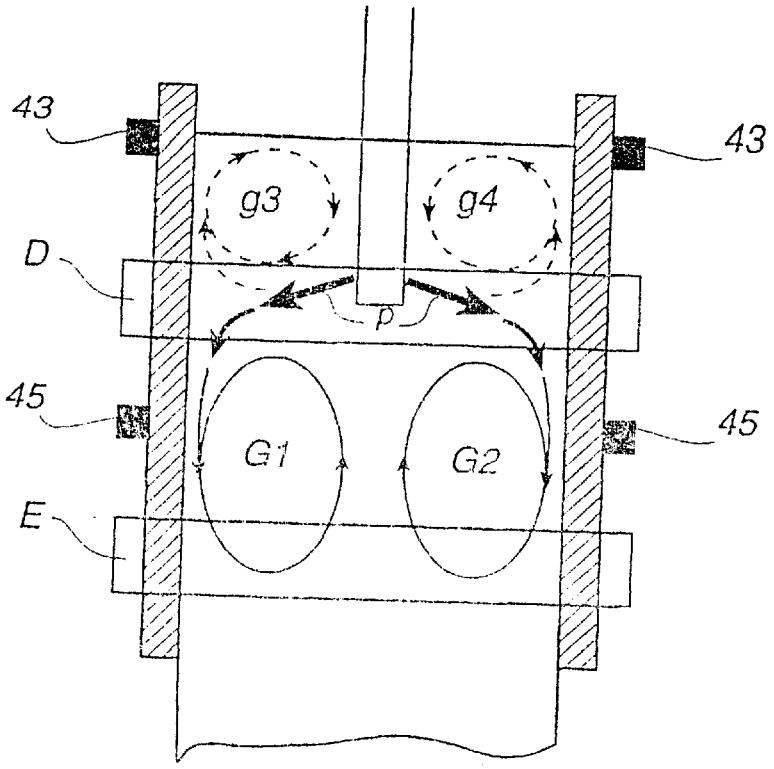

The width of the magnetic band areas D, E covers, also according to this embodiment, essentially the whole width of the cast product. With the configuration of the magnetic band areas D, E as shown in FIG. 3, a good braking of the primary flow p is obtained in combination with the development of a stable secondary flow G1 and G2 in a region between the band areas D, E which is supplemented by smaller but stable secondary flows g3 and g4 in the upper part of the mold, i.e., above band area D. Also in this situation is preferably the main secondary flow, i.e., G1 and G2 supervised preferably by monitoring it at the narrow side using suitable sensors 45. But also the minor flow at the top end g3 and g4 needs to be monitored using suitable sensors 43. The magnetic flux density of the magnetic field acting in band area D is preferably regulated. Preferably both the flow G1 and G2 and the flow g3 and g4 is maintained within preset limits, but at times it might prove favorable to regulated the magnetic flux density such that the polarity of one or both magnetic band areas is reversed. By arranging sensors 45 for monitoring the flows G1 and G2 separately the flows G1 and G2 can also be controlled independently the mold provided that the magnetic field forces acting on the melt can be controlled for each half of the mold. The same goes for g3 and g4.

Figure 4:
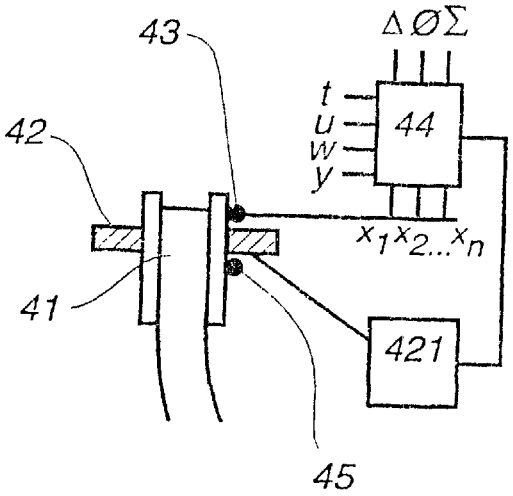
FIG. 4 schematically illustrates a device for carrying-out the method according to one embodiment of the present embodiment comprising a continuous casting mold, an electromagnetic brake and a control unit for supervising the casting conditions and regulate the brake based on changes in casting conditions.

The device shown in FIG. 4 illustrates the essential parts to carry out the invented method. Further to the mold 41 and the brake 42, the device also comprises;—detection means 43, 45 for supervision of one or more flow parameters in the mold; a control unit 44 associated with both the detection means 43, 45 and the magnetic means, i.e. the brake 42 or other device capable of regulating the magnetic flux density such as mechanical means for adjusting the distance between the front end of the magnetic core and the mold, or for inserting plates influencing the magnetic field between the magnet and the mold. The mold 41 shown in figure represents also all equipment associated with the mold to enable continuous or semi-continuous casting of one or more cast strand, such as support means, a system for supply and distribution of coolant, means for oscillating the mold, means for supply of hot metal to the mold and the complete casting machine needed for handling of the cast strand downstream of the mold. The brake 42 shown is an electromagnetic brake comprising magnets and associated parts such as a magnetic yoke, not shown, and a power source 421. The brake 42 is arranged and adapted to act upon the melt in the mold in such a way to create a desired secondary flow pattern in the mold. As an alternative to an electromagnetic brake can, provided that a sufficient magnetic flux density can be generated, a brake based on permanent magnets be used. The detection means 43,45 comprises at least sensors for supervision of one or more parameter characterizing the flow to be controlled but comprises further in some preferred embodiments sensors for continuous monitoring or sampling of further casting parameters. Suitable sensors for monitoring or sampling flow parameters is eddy-current based devices or devices comprising a permanent magnet for measurement of flow or levels inside vessel, such devices which are arranged outside the vessel is well-known in the metal industry for other purposes. The input means comprised in the control unit 44 is adapted to receive the signals $x_1$, $x_2$, . . . $x_n$ from the detection means 43 and in some embodiments also further signals y, w, t , u, et cetera from other sensors arranged to monitor or sample one or more casting parameters such as mentioned in the foregoing. In some embodiments the input means are also arranged to receive information Δ, ϕ, Σ, et cetera on preset conditions or parameters. According to some embodiments the input preferably also include means for receiving instructions on how the flow shall be controlled, e.g., within what limits certain parameters shall be maintained, if the flow shall be altered, thus enabling the operator to change the conditions on-line, e.g., enabling a change of direction in the flow by altering the magnetic flux density such that the polarities of the magnetic field(s) is reversed. The control unit 44 is preferably arranged in the form of a conventional electronic device with soft-ware in the form of a algorithm, statistical model or multivariate data-analysis for processing of information received through the input means such as casting parameters and information from the detection means 43 together with any other received information and based on the result of such processing regulate, through output means comprised in the control unit, the magnetic flux density. According to one embodiment of the invention the control unit 44 and the detection means are arranged within or associated with a neural network comprising electronic means for supervision and control of further steps and devices associated with the casting operation or the whole production in the plant. The output means comprised in the control unit 44 is adapted to regulate the magnetic flux density of the magnetic brake based on the processing in the control unit 44 of the input which at least comprises information of any change detected in a supervised flow parameter. For an electromagnetic brake the regulation of the magnetic flux density is preferably accomplished by controlling the amperage of the current fed from a power source to the windings in the electromagnets of the electromagnetic brake. This is accomplished by any current limiting device controlled by an out-signal from the control unit 44. Alternatively, it the electromagnet is connected to a power source where the voltage is controlled, the voltage is controlled by the out-signal from the control unit thus indirectly controlling the amperage of the current in the magnet windings. For a brake comprising permanent magnets in place of electromagnets the magnetic flux density is controlled by the distance between the front end of the magnets and the mold and/or by the material present between the magnets and the mold.

Figure 5:
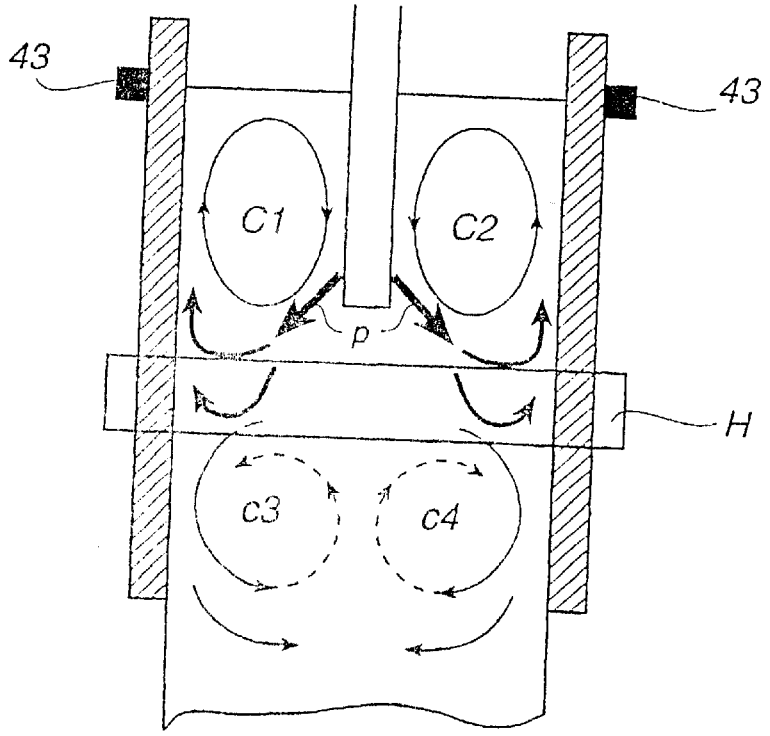

The flow pattern illustrated in FIG. 5 is typically developed for a method where a primary flow p of the hot melt enters the mold through side ports of a submerged entry nozzle and a brake is adapted to apply magnetic fields to act on the metal in the mold in a magnetic band area H at a level downstream the side ports. The width of the magnetic band area H covers preferably as shown in FIG. 5 essentially the whole width of the cast product. This configuration of the magnetic band area H, provides a significant circulating secondary flow C1 and C2 in the top end of the which is monitored by flow sensors 43. Downstream of the magnetic band area H might also a less stable circulating flow c3 and c4 develop, but the secondary flow is when casting according to the embodiment illustrated in FIG. 5 characterized by the braking and split of the primary flow caused by magnetic band area H resulting in a stable secondary flow C1 and C2 created by the cooperation of magnetic forces, induced currents and the momentum of the primary flow in the mold. In the situation shown in FIG. 5 is preferably the secondary flow C1 and C2 supervised by monitoring them, using suitable sensors 43 located either at the meniscus, at the narrow side or by monitoring the standing wave. The magnetic flux density is preferably regulated to maintain the flow C1 and C2 within preset limits, but at times it might prove favorable to regulated the magnetic flux density such that the polarity of one or both magnetic band areas is reversed. By arranging the sensors 43 for monitoring the flows C1 and C2 separately the flows C1 and C2 can also be controlled independently provided that the magnetic field forces acting on the melt can be controlled for each half of the mold.

Figure 6:
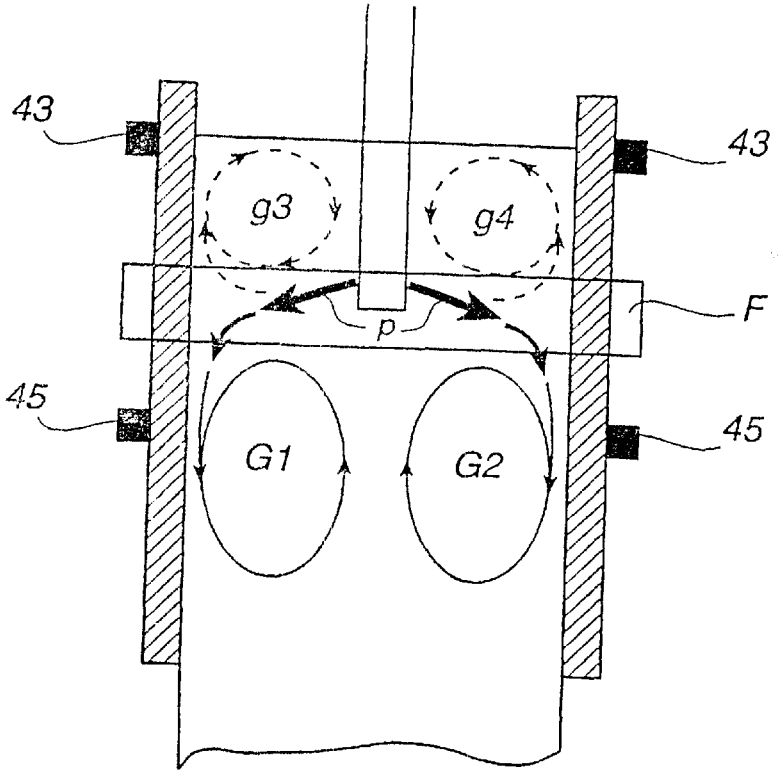

According to an alternative embodiment used in a similar mold and also for closed casting, the magnetic fields is applied to act in a magnetic band area F at a level with the side ports openings of the submerged entry nozzle. The width of the magnetic band area F covers, also according to this embodiment, essentially the whole width of the cast product. With the configuration of the magnetic band area F as shown in FIG. 6 a good braking of the primary flow p is obtained in combination with the development of a stable secondary flow G1 and G2 in a region below the band area F which is supplemented by smaller but stable secondary flows g3 and g4 in the upper part of the mold, i.e., above band area F. Also in this situation is preferably the main secondary flow, i.e., G1 and G2 supervised preferably by monitoring it at the narrow side using suitable sensors 45. But also the minor flow at the top end g3 and g4 needs to be monitored using suitable sensors 43. The magnetic flux density of the magnetic field acting in band area D is preferably regulated. Preferably both the flow G1 and G2 and the flow g3 and g4 is maintained within preset limits, but at times it might prove favorable to regulated the magnetic flux density such that the polarity of one or both magnetic band areas is reversed. By arranging sensors 45 for monitoring the flows G1 and G2 separately, the flows G1 and G2 can also be controlled independently in the mold provided that the magnetic field forces acting on the melt can be controlled for each half of the mold. The same goes for g3 and g4.

The flow pattern illustrated in FIG. 7 is typically developed for a method according to FIG. 5 supplemented by a substantial purge of a gas such as argon within the nozzle. Thus the primary flow p of the hot melt which enters the mold through side ports of the submerged entry nozzle is acted on by the gas-bubbles (Ar) and by the magnetic fields applied to act on the metal in the mold in a magnetic band area K at a level downstream the side ports. The width of the magnetic band area K covers preferably as shown in FIG. 5 essentially the whole width of the cast product. This configuration of the magnetic band area K combined with the upward flow of bubbles (Ar) along the nozzle surface, provides a significant circulating secondary flow O1 and O2 in the top end of the which is reversed, i.e., it is directed upward in the center of the mold flows outward towards the narrow sides at the meniscus, downward along the narrow sides and inward above the magnetic band area K. The reversed flow O1 and O2 is monitored by flow sensors 43. Downstream of the magnetic band area K might also a less stable circulating flow c3 and c4 develop, which might be either reversed or normal. The secondary flow is when casting according to the embodiment illustrated in FIG. 7, using gas purging in the nozzle, characterized by the braking and split of the primary flow caused by magnetic band area K in combination with the flow of gas bubbles (Ar) resulting in a stable secondary flow C1 and C2 created by the cooperation of magnetic forces, induced currents, gas bubbles (Ar) and the momentum of the primary flow in the region at the nozzle ports. In the situation shown in FIG. 7 is preferably the reversed secondary flow O1 and O2 supervised by monitoring them, using suitable sensors 43 located either at the meniscus, at the narrow side or by monitoring the standing wave. The magnetic flux density is preferably regulated to maintain the reversed flow-pattern and also the flow velocities of O1 and O2 within preset limits, but at times it might prove favorable to regulated the magnetic flux density such that the polarity of one or both magnetic band areas is reversed. By arranging the sensors 43 for monitoring the flows O1 and O2 separately the flows O1 and O2 can also be controlled independently provided that the magnetic field forces acting on the melt can be controlled for each half of the mold.

Figure 8:
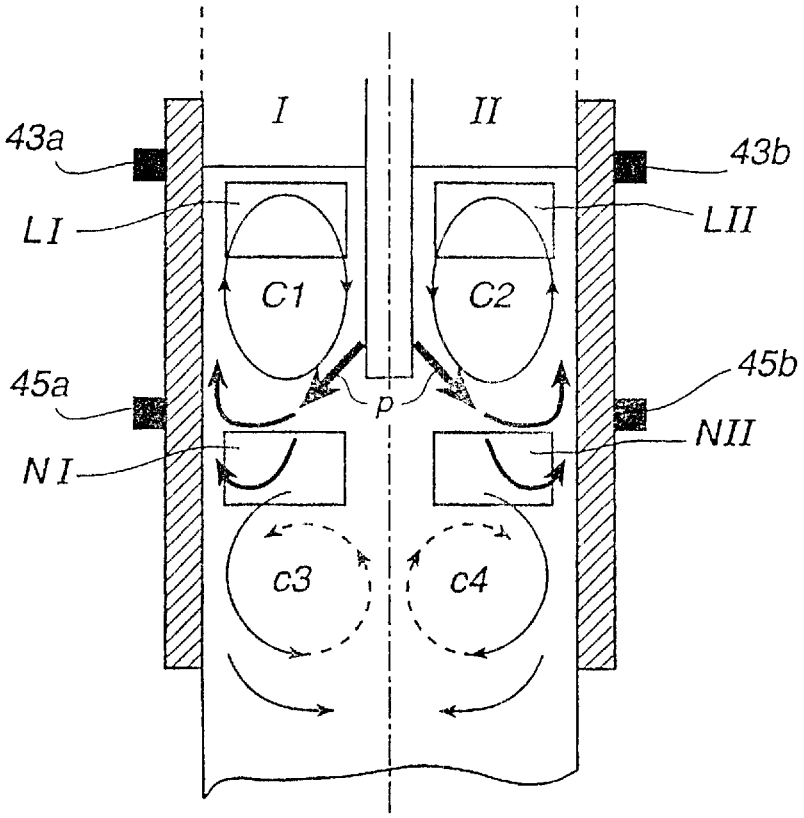

The flow pattern illustrated in FIG. 8 is typically developed for a method where a primary flow p of the hot melt enters the mold through side ports of a submerged entry nozzle a brake is adapted to apply magnetic fields to act on the metal in the mold;

at two zones LI, LII in a first magnetic band area L at a level with the meniscus or at a level between the meniscus and the side ports, the two zones being located at the sides of the nozzle; and at two zones NI, NII in a second magnetic band area N at a level downstream the side ports, the two zones being located at the sides of the nozzle.

For control purposes the mold is split in half in the casting direction in such a way that it comprises two control zones I, II, where control zone I comprises magnetic zones LI and NI and detection means 43*a,* 45*a* for monitoring the flow in this zone I and control zone II comprises magnetic zones LII and NII and detection means 43*b,* 45*b* for monitoring the flow in this zone II. Using two control zones ensures that an essentially symmetrical and balanced two-loop flow is developed in the upper part of the mold. Thereby the risks of an unsymmetrical, unbalanced so called biased two-loop flow is developed or even in the extreme case transforming into an undesired one-loop flow, where the melt flows up along one molds side, across the meniscus to the other side, down and further back across the mold at level N. is eliminated. A biased flow increases the risks for turbulence and vortexes at the meniscus and thus affects the cleanliness of the metal as the removal of non-metallic particles, gas bubbles is impaired and the tendency for mold power to be drawn down into the metal is increased. The magnetic zones LI, LII, NI, NII are preferably as shown in FIG. 8 located such that a central area comprising the nozzle is essentially free from magnetic fields but also a method using magnetic zones with essentially the same width as the control zones I, II, i.e. which wholly or partly covers the nozzle will result in a similar secondary flow. This configuration of the magnetic zones LI, LII, NI, NII, provides a significant circulating secondary flow C1 and C2 in the top end of the mold, between the two levels L and N, which is similar to the flow in FIGS. 2 and 5. The flow is monitored by flow sensors 43*a,* 43*b*. Downstream of the second lower level N might also a less stable circulating flow c3 and c4 develop, but the secondary flow is when casting according to the embodiment illustrated in FIG. 8 is characterized by the braking and split of the primary flow caused by magnetic zones NI and NII resulting in a stable secondary flow C1 and C2 created by the cooperation of magnetic forces, induced currents and the momentum of the primary flow in the region between the two levels. In the situation shown in FIG. 8 the secondary flow C1 and C2 is preferably supervised by monitoring using suitable sensors 43*a,* 43*b* located in both control zones I, II either at the meniscus, at the narrow side, or by monitoring the standing wave. The magnetic flux density of one or both of LI, NI is preferably regulated to maintain the flow C1 using sensors 43*a* for monitoring the flow C1 and the magnetic flux density of one or both of LII, NII is preferably regulated to maintain the flow C2 within preset limits using sensors 43*b* for monitoring the flow C2.

What is claimed is:

1. A method for continuous or semi-continuous casting of metal comprising the steps of supplying a primary flow (p) of hot metallic melt into a mold wherein the melt will at least partially solidify into a cast strand, (b) applying at least one static or periodically low-frequency magnetic field having a flux density to the melt in the mold to brake and split the primary flow of hot metallic melt and form a controlled secondary flow in the non-solidified parts of the cast strand, (c) controlling the magnetic flux density of the magnetic field based on casting conditions, (d) detecting changes in the secondary flow in the cast strand, (e) supplying information on detected changes in the secondary flow to a control unit where the changes are evaluated, and (f) regulating the magnetic flux density on-line based on said evaluation to maintain or adjust the controlled secondary flow.

2. A method according to claim 1, wherein in step (d) secondary flow velocity is continuously measured at one specific point in the mold.

3. A method according to claim 1, wherein in step (d) secondary flow velocity is intermittently measured at one specific point in the mold.

4. A method according to claim 1, wherein in step (d) flow velocity is measured at a meniscus of said melt at a wall of said mold, and in step (f) the magnetic flux density is regulated to maintain flow velocity at said meniscus within a predetermined range.

5. A method according to claim 1, wherein said mold comprises opposite and long walls and opposite narrow walls, wherein in step (d) flow velocity is measured in an upwardly-moving secondary flow adjacent a narrow wall of said mold, and wherein in step (f) flow velocity in said upwardly-moving secondary flow is regulated.

6. A method according to claim 1, wherein in step (d) a flow characteristic such as height, location or shape is measured in a standing wave created at a meniscus of said melt at a wall of said mold by upwardly-moving secondary flow of melt.

7. A method according to claim 1, wherein in step (d) flow velocity is measured in separated control zones in said mold, and wherein in step (f) magnetic flux density is regulated in each of said two control zones.

8. A method according to claim 7, wherein said two separated control zones are respectively located in left and right halves of the mold, and wherein in step (f) the regulating of magnetic flux density maintains symmetrical and balanced flow in the mold.

9. A method according to claim 8, wherein in step (d) flow velocity is measured at a meniscus of said melt at a respective walls adjacent each control zone.

10. A method according to claim 8, wherein in step (d) flow velocity is measured in an upwardly-moving secondary flow adjacent narrow walls of said mold respectively adjacent each control zone.

11. A method according to claim 8, wherein in step (d) a flow characteristic such as height, location or shape is measured in a standing wave created at a meniscus of said melt at a respective narrow wall of said mold adjacent each control zone by upwardly-moving secondary flow of melt.

12. A method according to claim 1, wherein in step (e) the control unit evaluates information supplied thereto using an algorithm.

13. A method according to claim 1, wherein the step (e) the control unit evaluates information supplied thereto using a statistical model.

14. A method according to claim 1, wherein step (e) the control unit evaluates information supplied thereto using a data-analysis program.

15. A method according to claims 12, 13 or 14 wherein at least one of the following parameters is considered:

mold dimensions, nozzle dimensions and nozzle configuration including the angle of the ports and immersion depth, dimensions, configuration and position of magnetic poles;

composition of metal casted;

composition of mold powder used, and flow of any gas purged.

16. A method according to claim 15 wherein at least one of the following additional parameters is considered:

superheat of metal upon entry into mold;

ferrostatic pressure at nozzle exit;

flow velocity of primary flow upon exit from nozzle;

any gas bubbling in mold;

casting speed;

mold powder addition rate;

position of meniscus in mold and relative nozzle port;

position of nozzle port relative mold;

position of magnetic field(s) relative meniscus and nozzle ports; and direction of magnetic field.

17. A method according to claim 1 wherein in step (f) amperage of current from a power source to a winding of an electromagnetic brake is controlled.

18. A method according to claim 1, wherein in step (b) two low-frequency magnetic fields are applied to the melt in the mold.

19. A method according to claim 18, wherein said two low-frequency magnetic fields are applied at two spaced downstream levels in said mold.

20. A method according to claim 19 wherein in step (a) said primary flow of hot metallic melt is supplied through ports in a nozzle immersed in said melt in said mold, and wherein one of said magnetic fields is dispersed at a location level with or downstream of said ports, and a second of said two magnetic fields is located at a level with a meniscus of said melt or between said meniscus and said ports.

21. A method according to claim 19, wherein in step (a) said primary flow of metallic melt is supplied through ports in a nozzle immersed in said melt in said mold, and wherein one of said two magnetic fields is disposed at a first location level with said ports and a second of said two magnetic fields is disposed at second location downstream of said first location.

22. A method according to claim 18, wherein step (f) comprises separately regulating the magnetic flux density of said two magnetic fields.

23. A method according to claim 1, including providing an alternating magnetic field acting on said melt or produced strand and including a step of controlling said alternating magnetic field on-line.

24. A device for continuous or semi-continuous casting of metals comprising a mold for forming a cast strand, supply means for supplying a primary flow of hot metallic melt to the mold, a control unit having an evaluation means, detection means for monitoring secondary flow of melt in said mold and sending signals to said control unit, and magnetic means for applying a magnetic field in the melt in the mold, said control means controlling said magnetic means and the magnetic flux density of said magnetic field based on flow changes detected by said detection means.

25. The device of claim 24, including multiple detection means for detecting secondary flow characteristics in multiple control zones in said mold.

26. The device of claim 25, comprising two detection means located on respective right and left halves of said mold.

27. The device of claim 24, wherein said detection means comprises a magnetic flowmeter operating on eddy current technique for measuring flow velocity, and wherein the control means includes software based on algorithm, statistical model or multivarate data analysis.

28. The device of claim 24, wherein said detection means is a temperature sensor.

29. The device of claim 24, wherein said detection means comprises a magnetic flow meter to monitor height, location or shape of a standing wave generated by upwardly-moving secondary flow at a meniscus.

30. The device claim 24, wherein said control unit comprises a neural network.

31. The device of claim 24, comprising a plurality of magnetic means for applying multiple magnetic fields in said mold.

32. The device of claim 24, comprising multiple magnetic means located in one or spaced downstream levels in said mold.

33. The device of claim 24, wherein said control means controls said multiple magnetic means.

* * * * *